US010617225B1

(12) United States Patent
Wildeman

(10) Patent No.: US 10,617,225 B1
(45) Date of Patent: Apr. 14, 2020

(54) STRETCHABLE FLAME BARRIER PANELS

(71) Applicant: TIETEX INTERNATIONAL, LTD., Spartanburg, SC (US)

(72) Inventor: Martin Wildeman, Spartanburg, SC (US)

(73) Assignee: TIETEX INTERNATIONAL LTD., Spartanburg, SC (US)

( * ) Notice: Subject to any disclaimer, the term of this patent is extended or adjusted under 35 U.S.C. 154(b) by 0 days.

(21) Appl. No.: 16/351,340

(22) Filed: Mar. 12, 2019

Related U.S. Application Data

(60) Provisional application No. 62/743,780, filed on Oct. 10, 2018, provisional application No. 62/684,563, filed on Jun. 13, 2018, provisional application No. 62/641,636, filed on Mar. 12, 2018.

(51) Int. Cl.
*A47C 31/00* (2006.01)
*A47C 27/00* (2006.01)
*A47C 27/20* (2006.01)

(52) U.S. Cl.
CPC ..... *A47C 31/001* (2013.01); *A47C 27/008* (2013.01); *A47C 27/20* (2013.01); *Y10T 428/24785* (2015.01); *Y10T 442/643* (2015.04)

(58) Field of Classification Search
CPC ... A47C 27/002; A47C 27/003; A47C 31/001; A47C 27/008; A47C 27/20; Y10T 428/24785; Y10T 442/643
USPC ..... 442/328, 329, 366
See application file for complete search history.

(56) References Cited

U.S. PATENT DOCUMENTS 8,021,735 B2 * 9/2011 Tsiarkezos ..... A47C 27/002 112/402
2003/0124939 A1 * 7/2003 Zafiroglu ..... D04H 1/06 442/352
2018/0360227 A1 * 12/2018 Martin ..... A47C 31/001

* cited by examiner

*Primary Examiner* — Elizabeth C Imani
(74) *Attorney, Agent, or Firm* — J. M. Robertson, LLC

(57) ABSTRACT

A stretchable flame barrier panel including an interior stretch zone having elastomeric yarns extending across a fibrous base layer of textile fibers and optionally substantially stable lateral selvage zones outboard of the interior stretch zone. In a finished state, the interior stretch zone has substantial stretch and recovery in both the machine direction and the cross-machine direction.

14 Claims, 4 Drawing Sheets

STRETCHABLE FLAME BARRIER PANELS

CROSS REFERENCE TO RELATED APPLICATIONS

This application claims the benefit of, and priority from, U.S. provisional applications 62/641,636 having a filing date of Mar. 12, 2018; 62/684,563 having a filing date of 13 Jun. 2018; and 62/743,780 having a filing date of 10 Oct. 2018. The contents of all such prior applications are hereby incorporated by reference in their entirety.

TECHNICAL FIELD

The present disclosure relates generally to mattresses, and more particularly, to stretchable fabric panels adapted for use in a mattress characterized by substantial stretch and recovery. Features consistent with the present disclosure may have application in environments such as residential and commercial mattresses and more particularly in mattresses incorporating one or more stretchable fabric panels disposed in overlying relation to a resilient core interior of foam or the like wherein a combination of enhanced flame resistance and controlled stretch characteristics are desirable. Features consistent with the present disclosure also may have application in any number of other environments where insulation in combination with stretch and recovery are desired including protective apparel, stretchable sports garments and the like.

BACKGROUND OF THE DISCLOSURE

It is known to provide mattresses with stretchable fabric panels positioned between a resilient mattress core and a decorative textile covering. In one approach, prior flame barrier panels have been formed from non-woven materials of fleece construction incorporating inherently flame-retardant fiber constituents either alone or blended with other fibrous constituents. By way of example only, and not limitation, such prior flame barrier materials have been formed from materials such as: (i) flame retardant rayon alone; (ii) flame retardant rayon blended with para-aramid fibers; (iii) flame retardant rayon blended with para-aramid fibers and polyester; and (iv) other fibers or blends having flame retardant properties including modacrylic, wool, meta-aramid and the like.

While the prior known flame barrier materials provide good flame blocking and insulation character, they typically have limited capacity to stretch and recover. This limitation may be particularly problematic with respect to mattresses which incorporate core materials such as latex foam, polyurethane foam and the like which may be required to undergo substantial localized deformation during use.

One approach used to address the lack of stretch and recovery in flame barrier panel materials has been to encapsulate the mattress foam core in a circular knit sock structure formed from flame retardant yarns having a fiberglass core, which is often wrapped with a textile fiber covering. Such a sock structure provides an inherent degree of stretch and recovery due to the circular knit construction. However, such sock structures may be somewhat difficult to manufacture and use due to the size and weight of the mattress cores which must be inserted.

Due to the deficiencies in the known art, there is a continuing need for a mattress incorporating stretchable fabric panels with substantial stretch and recovery corresponding to an underlying mattress core while providing continuous coverage over the full range of stretch.

SUMMARY OF THE DISCLOSURE

In accordance with one exemplary aspect, the present disclosure provides advantages and alternatives over the prior art by providing a mattress incorporating a stretchable fabric of stitch-bonded construction formed from at least one fibrous base layer with a plurality of elastomeric yarns such as covered spandex, Hytrel® or the like engaging the fibrous base layer to form an interior stretch zone. The fibrous base layer may be a nonwoven material formed from fibers such as silica rayon fiber; rayon fibers treated with flame retardant chemicals; polyester fibers treated with flame retardant chemicals; para-aramid fibers; meta-aramid fibers; modacrylic fibers; wool and combinations of any of the forgoing. Inherently flame-retardant fibers may be particularly preferred. The fibrous base layer typically lacks inherent stretch and recovery properties. In this regard, while the fibrous base layer may be stretched under tension, it does not have the inherent ability to substantially return to a pre-stretched condition. The fibrous base layer may be formed by any technique suitable to provide a cohesive structure which can undergo further processing. By way of example only, and not limitation, the fibrous base layer may be formed from a plurality of relatively short staple-length fibers formed into a cohesive structure. One suitable formation technique is carding and cross-lapping either with or without subsequent needling. However, other techniques including air laying, compaction rolling, and the like may also be used. Such techniques provide generally cohesive nonwoven webs which can be further stabilized by mechanical, chemical or thermal bonding between the fibers if desired. As will be recognized, the foregoing techniques may all provide fibrous structures wherein the fibers are highly oriented in defined directions. However, techniques providing substantially random fiber orientations may likewise be used if desired. The fibrous base layer may also be a substantially inelastic pre-formed fabric or other sheet substrate, such as a woven fabric, a knitted fabric, or the like formed from spun or filament yarns of suitable textile fiber.

In accordance with one exemplary practice, the fibrous base layer may be a fleece formed by carding and cross-lapping relatively short, staple-length fibers. The carded and cross-lapped structure may be optionally needled to enhance entanglement between fibers and further increase coherency. If desired, such a fleece structure (either with or without needling) may undergo preliminary stretching (also known as "drafting") in the machine direction prior to subsequent processing. Such drafting causes the fleece to neck down to a reduced width while concurrently reorienting a percentage of fibers away from alignment with the cross-machine direction ("width") and towards alignment with the machine direction ("length").

A stretchable fabric consistent with the present disclosure may also incorporate lateral selvedge zones stitched with shrinkable yarns such as polyester POY or the like either alone or in combination with elastomeric yarns. The shrinkable yarns shorten during fabric processing such that the selvage zones provide enhanced dimensional stability along the fabric edges in a finished condition. In this regard, the dimensional stability imparted by the shrunken yarns in the selvage zones limits stretch in the machine direction. However, substantial stretch and recovery characteristics are still present in the interior stretch zone through use of elastomeric yarns engaging the fibrous base layer in combination with controlled shrinkage during finishing.

In accordance with one exemplary practice, a stretchable fabric consistent with the present disclosure may be subjected to heat and/or moisture treatment after forming the interior and selvage zones to effect substantial shrinkage and to fix the fabric structure in a shrunken state. In the finished fabric, the lateral selvedge zones preferably have substantially greater thickness and/or compressibility than the interior stretch zone.

After fabric formation and shrinkage treatments are complete, the resulting fabric may be wound onto a roll for storage and subsequent use. During the winding operation, the stable selvedge zones may carry a higher tension than the interior stretch zone. In a potentially preferred practice, enhanced compressibility built into the selvedge zones may substantially prevent distortion along the length of the roll which would otherwise occur.

During use in a mattress, the interior fabric zone having elastomeric stitching yarns will provide a significant degree of stretch and recovery in both the machine direction and the cross-machine direction. Conversely, the shrunken yarns in the selvedge zones impart substantial edge stability in the machine direction.

In the finished fabric, the interior fabric zone may be substantially resistant to shrinkage under steaming and/or dry heat conditions. Thus, the fabric may be resistant to undesired contraction during processing and use. If the elastomeric stitching yarns are damaged by flame impingement or other forces, the fabric nonetheless substantially maintains its finished dimensions and thereby continues to provide a desired degree of flame resistance.

Other exemplary aspects of the disclosure will become apparent upon review of the following detailed description of preferred embodiments and practices.

BRIEF DESCRIPTION OF THE DRAWINGS

The accompanying drawings, which are incorporated in, and which constitute a part of this specification, illustrate exemplary constructions and procedures in accordance with the present disclosure and, together with the general description of the disclosure given above and the detailed description set forth below, serve to explain the principles of the disclosure wherein.

While constructions consistent with the present disclosure have been illustrated and generally described above and will hereinafter be described in connection with certain potentially preferred embodiments and practices, it is to be understood that in no event is the disclosure limited to such illustrated and described embodiments and practices. On the contrary, it is intended that the present disclosure shall extend to all alternatives and modifications as may embrace the general principles of this disclosure within the full and true spirit and scope thereof. Also, it is to be understood that the phraseology and terminology used herein are for purposes of description only and should not be regarded as limiting. The use herein of terms such as "including" and "comprising" and variations thereof is meant to encompass the items listed thereafter and equivalents thereof as well as additional items and equivalents thereof.

DESCRIPTION

Figure 1:
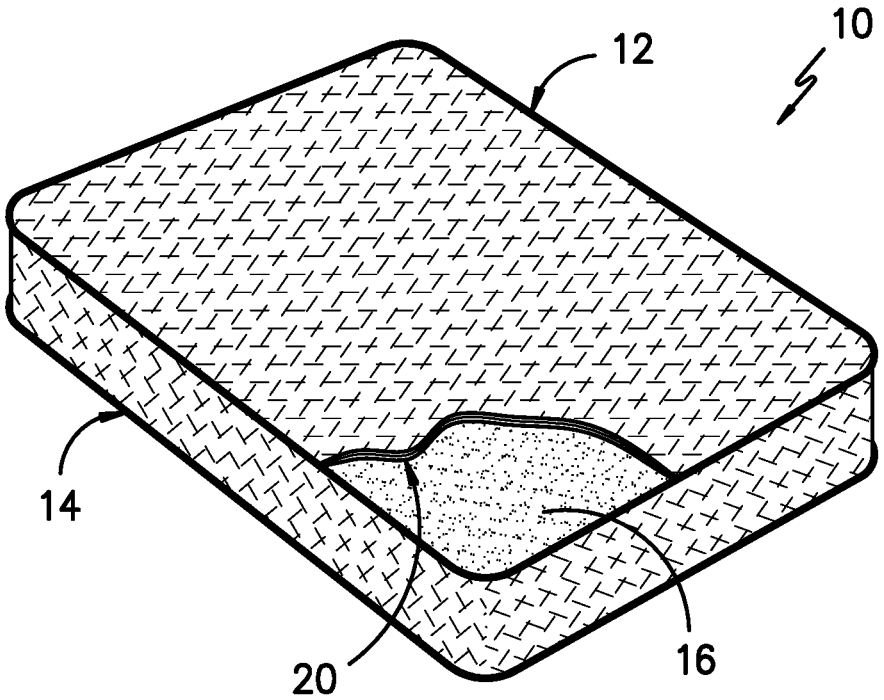
FIG. 1 is a partial cut-away view of an exemplary mattress construction consistent with the present disclosure.
Figure 2:
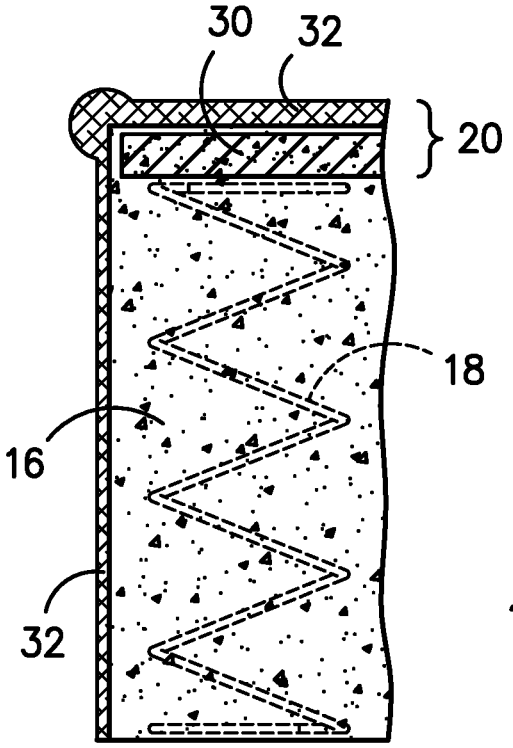
FIG. 2 is a cross-sectional view of the exemplary mattress construction of FIG. 1 consistent with the present disclosure incorporating a stitch-bonded stretchable fabric panel.

Reference will now be made to the drawings, wherein to the extent possible like reference numerals are utilized to designate corresponding components throughout the various views. In FIG. 1 there is illustrated a mattress 10 having an upper face 12 and sides 14. In the illustrated exemplary construction, the mattress 10 generally includes a core 16 of foam alone or in combination with supporting springs 18 (FIG. 2). By way of example only, and not limitation, the foam may be a visco-elastic polyurethane foam, latex foam, or the like having a density of about 1-12 pounds per cubic foot and more preferably about 3 to 7 pounds per cubic foot although other resilient foams and densities may likewise be utilized. The foam core 16 may have a continuous stiffness throughout the thickness of the mattress 12 or may be layered with different materials and varying stiffness levels at different positions in the thickness dimension.

In the illustrated arrangement, the core 16 is at least partially covered with an overlay structure 20 (FIG. 2). As illustrated, the overlay structure 20 includes at least one layer of a stretchable fabric 30 of stitch-bonded construction consistent with the present disclosure. If desired, panels of stretchable fabric 30 may also be disposed at corresponding locations within sides 14. A covering layer 32 of decorative fabric ticking such as a circular knit fabric or the like may be disposed in overlying relation to the stretchable fabric 30. As will be appreciated, while the stretchable fabric 30 is illustrated as being in direct contact with both the core 16 and the covering layer 32, it is likewise contemplated that one or more intermediate layers may be interposed between the stretchable fabric and the core 16 and/or between the stretchable fabric and the covering layer 32.

If desired, the stretchable fabric 30 may be adjoined to the covering layer 32. Such connection may be at intermediate discreet positions or may be along a substantially continuous interface. By way of example only, such connection may be made by quilting, adhesive bonding or other techniques as may be known to those of skill in the art.

In accordance with one exemplary practice, a stretchable fabric 30 consistent with the present disclosure may be a so called "stitch-bonded" fabric formed by introducing stitching yarns of predefined character through one or more plies of a nonwoven fibrous fleece substrate material using a stitch-bonding machine as will be well known to those of skill in the art. In this regard, the stitching yarns and patterns used at the interior of stretchable fabric 30 may impart a stretchable character within the interior while the stitching yarns and patterns used at the selvedge zones may provide dimensional stability and resistance to stretch.

It is also contemplated that fabric formation practices other than stitch-bonding may likewise be used to provide stretchable character if desired. By way of example only and not limitation, such non-stitchbonding practices may include applying elastomeric yarns through a fibrous base in an expansible pattern such as a repeating diamond pattern or the like. In such a construction, the pattern facilitates expansion under tension and subsequent recovery despite the substantially inelastic character of the fibrous base. Such patterns may be applied by techniques such as quilting or the like.

During an exemplary and potentially preferred stitch-bonding process, a plurality of closely spaced needles 34 (shown in greatly exaggerated dimension) pierce a fibrous base 25 of textile fibers such as a carded and cross-lapped fleece or other suitable material and engage a first set of stitching yarns 36 for applying a first stitching pattern across a defined portion of the fibrous base 25. The needles 34 may also engage a second set of stitching yarns 38 for applying a second stitching pattern along only the lateral selvedge zones at the edges of the fibrous base 25 as will be described further hereinafter.

During the stitching procedure, the stitching yarns are captured within a hook portion of the needles 34. As the needle 34 is reciprocated downwardly, a closing element such as a closing wire which moves relative to the needle 34 closes the hook portion to hold the captured stitching yarn therein. With the hook portion closed, the captured stitching yarn is pulled through the interior of an immediately preceding yarn loop disposed around the shank of the needle 34. As the captured stitching yarn is pulled through the interior of the preceding yarn loop, a stitch is formed which is knocked off the needle 34. As the needle 34 is raised back, the hook portion is re-opened and a new yarn loop moves out of the hook portion and is held around the shank of the needle 34 for acceptance of the yarn and formation of a subsequent stitch during the next down stroke.

In accordance with the present disclosure, one exemplary fibrous base 25 for use in the stretchable fabric 30 may be a substantially 100% flame retardant silica rayon fiber fleece. However, other materials may be used if desired. By way of example only, such other materials may include rayon fibers treated with FR ("flame retardant") chemicals, para-aramid, meta-aramid, modacrylic, wool and other fibers with FR properties. Materials such as FR treated or coated polyester or cotton and blends of any of the foregoing may also be used if desired. All such materials are flame retardant fibers. In this regard, one contemplated blend which may be particularly desirable is flame retardant silica rayon fiber blended with some percentage of para-aramid and/or meta-aramid fiber. One exemplary blended fibrous substrate material for use in the stretchable fabric 30 may be a blend of about 95% flame retardant silica rayon fiber and about 5% Para-aramid fiber. Higher percentages of Para-aramid fiber up to about 25% or more may be used if desired. It is also contemplated that in some applications a fibrous base of substantially all polyester fiber may be used either with or without FR treatment if desired.

Regardless of the materials used, the fibrous base 25 is preferably formed from a plurality of staple length fibers having an average length in the range of about 1 to 5 inches. These staple fibers may be carded and cross-lapped with an optional subsequent needling step to form a preliminary fleece structure wherein the majority of the fibers are oriented substantially in the cross-machine direction. In such a carded and cross-lapped preliminary fleece structure the fibers typically form an angle within plus or minus 20 degrees of a line parallel to the cross-machine direction. That is, most of the fibers will be substantially aligned close to the cross-machine direction. In this regard, since a fiber in a nonwoven construction does not typically extend in a straight line, the orientation of a fiber relative to a reference line may be defined by reference to a line connecting the fiber ends as described in U.S. Pat. No. 9,090,801 to Siebert et al. which is hereby incorporated by reference in its entirety.

Figure 3:
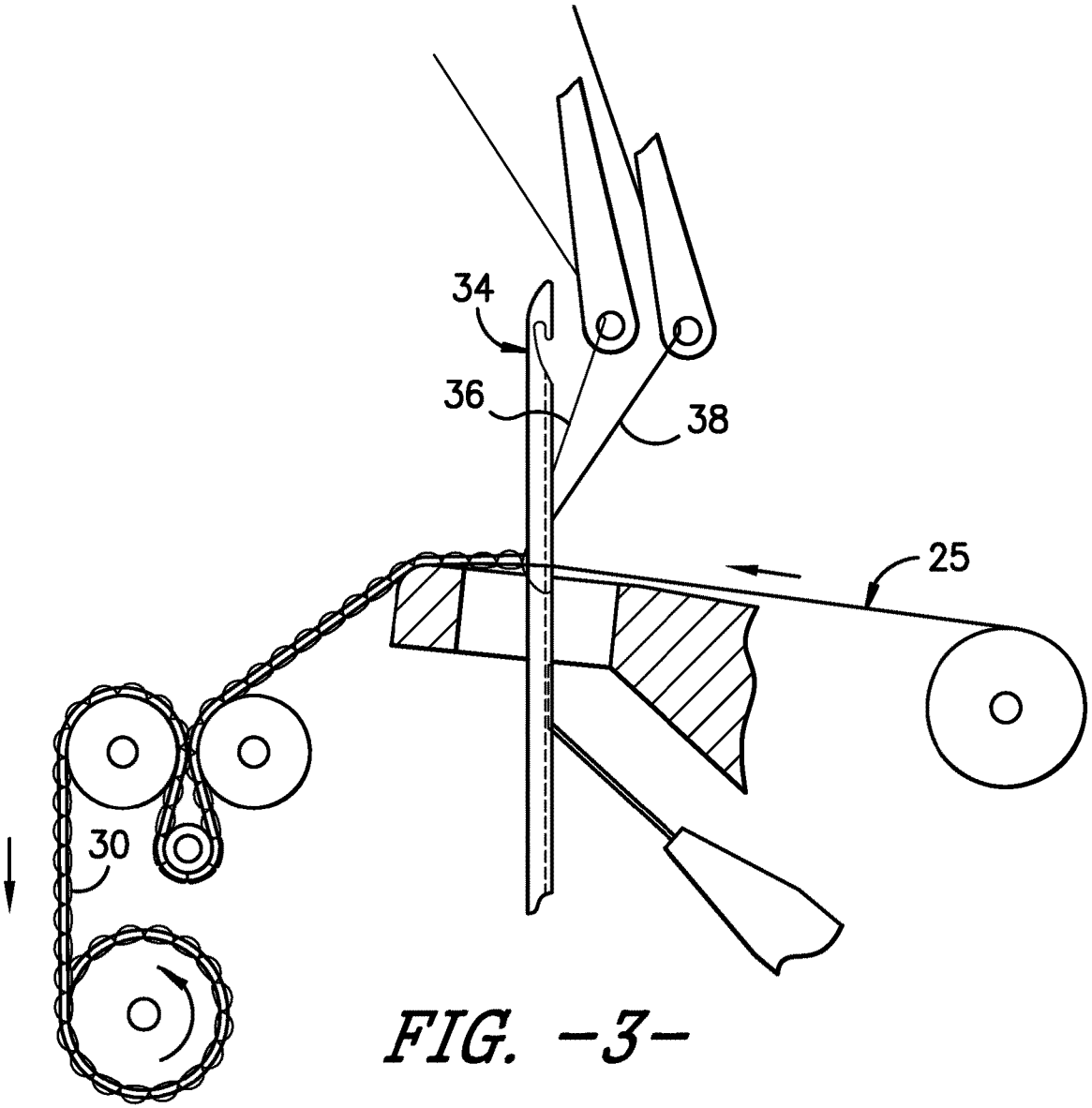
FIG. 3 is a schematic view of an exemplary two bar stitch-bonding fabric formation process.

In accordance with one exemplary and potentially preferred practice, prior to the stitching process illustrated in FIG. 3, the preliminary fleece structure may undergo a process such as stretching, air laying, web condensing, hydroentanglement or the like to orient or reorient a substantial percentage of the staple fibers to achieve a generally balanced orientation between the machine direction and the cross-machine direction in the fibrous base material 25. By way of example only, and not limitation, the preliminary fleece structure may be stretched prior to stitching to increase the length and reduce the width of the fleece entering the stitching zone. Such stretching (also referred to as "drafting") may reorient fibers within the fibrous base such that a majority of the fibers in the fibrous base 25 are oriented at an angle between 25 degrees and 75 degrees relative to a line extending parallel to the cross-machine direction following the stretching process. Such reorientation of the fleece fibers prior to stitching may facilitate the ability of the final fabric to stretch in the cross-machine direction. In one exemplary practice the fibrous base material 25 may be stretched to reduce the width from 163 inches to 125 inches prior to stitching. However, other degrees of stretching may likewise be used as desired.

The mass per unit area of the fibrous base 25 before stitching is preferably about 85 grams per square meter to about 300 grams per square meter and is most preferably about 95 grams per square meter. The mass per unit area of the stitched greige fabric emerging from the stitch bonding process is preferably about 100 grams per square meter to about 320 grams per square meter and is most preferably about 110 grams per square meter. A fibrous base 25 used in the stretchable fabric 30 may be characterized by relatively low inherent stretch and recovery capacity. In this regard, the fibrous base 25 can typically be stretched by the application of tensile forces but exhibits very little recovery when those tensile forces are removed.

Figure 4:
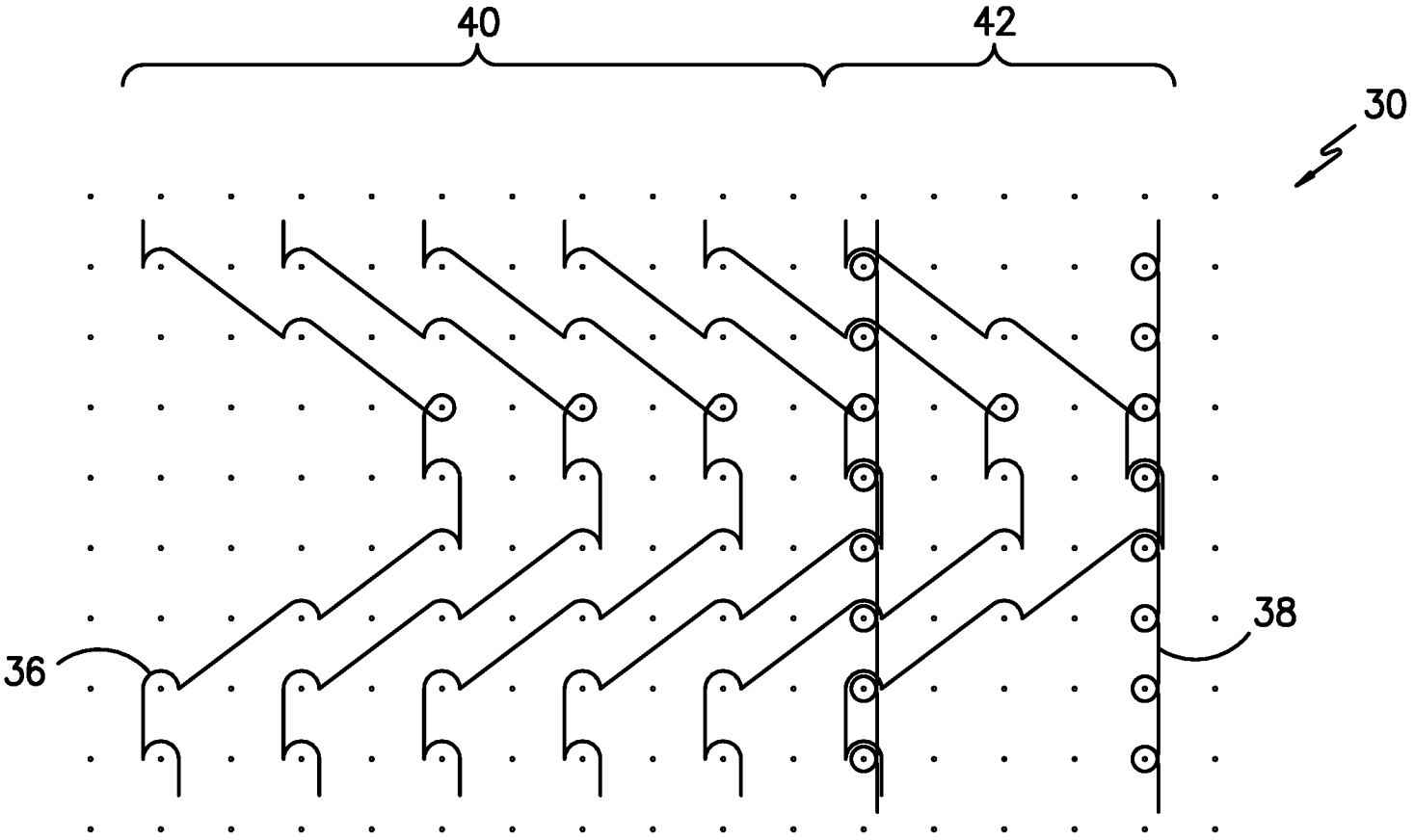
FIG. 4 is a schematic view illustrating an exemplary stitching pattern for a stitch-bonded stretchable fabric for use in a mattress consistent with the present disclosure.

FIG. 4 illustrates one exemplary and potentially preferred construction for a stretchable fabric 30 which may be formed on a two-bar stich-bonding machine for use in a mattress consistent with the present disclosure. As will be understood, in such a diagram each column of dots corresponds to a needle position and each dot represents a needle perforation. In accordance with the illustrated exemplary practice, the stretchable fabric 30 may have an interior stretch zone 40 disposed between two lateral selvage zones 42 (only one shown). The interior stretch zone 40 may be stitched with light-weight elastomeric stitching yarns 36 such as spandex or the like yarns with a linear density of about 30 denier to about 300 denier, more preferably about 50 denier to 150 denier, and most preferably about 70 denier or less wrapped with a textured polyester yarn with high set properties. By way of example only, one such covering yarn is a 75 denier/34 filament textured polyester yarn. Within the interior stretch zone 40 forming the main body of the stretchable fabric 30, the elastomeric stitching yarns 36 may be stitched with the yarn cover substantially extended. Other yarns may be stitched within the interior stretch zone 40 if desired but are not required.

The term elastomeric stitching yarns will be understood to mean stitching yarns with a stretch capacity of at least 50%, and more preferably at least 100%, prior to breakage and which will return to within 10% of their initial length following 50% stretching under standard atmospheric conditions. That is, the length after stretching to 50%, holding the stretched condition for not more than 5 seconds, and release will preferably be not more than 110% of the length before stretching and will more preferably be in the range of 100% to 105% of the length before stretching. Yarns without these features are non-elastomeric.

In one exemplary construction, the elastomeric stitching yarns 36 may be stitched at the interior stretch zone 40 using about 3.5 to 18 needles per inch in the cross-machine direction, and more preferably 7 needles per inch (i.e. 7 gauge) in a so called 14 gauge "1 miss 1" threading arrangement such that every other needle within the interior stretch zone engages an elastomeric stitching yarn 36. As illustrated, one exemplary stitch pattern for the elastomeric stitching yarns 36 in the interior stretch zone 40 is 1-0/0-1/1-0/2-3/4-5/5-4/4-5/3-2// (14 gauge) using flat (i.e. non-pile) stitches. Such a stitching pattern provides a substantial cross-machine direction (i.e. horizontal) component to the elastomeric stitching yarns 36 within the stretchable fabric 30 while still maintaining a substantial machine-direction (vertical) component. The stitch density in the machine direction may be about 5 to 20 courses per inch and is preferably about 10 courses per inch. Of course, different stitching yarns, patterns, and spacings in the machine direction and/or cross-machine direction may be used as desired.

As indicated previously, the stretchable fabric 30 also includes shrinkable selvedge zones 42 along the lateral edges outboard from the interior stretch zone 40 (only one shown). In a finished condition following shrinkage, these selvedge zones 42 provide substantial machine-direction stability to aid in processing and use of the stretchable fabric 30. In the illustrated exemplary construction, the selvedge zones 42 may incorporate the same elastomeric stitching yarns 36 and stitching patterns used in the interior stretch zone. The selvedge zones 42 also incorporate shrinkable selvage stitching yarns 38 such as a 70 denier to 600 denier (preferably about 285 denier or similar weight) undrawn multi-filament polyester POY or other partially oriented yarn applied from the back bar of the stitch-bonding machine. As will be understood, such yarns may undergo substantial shrinkage of about 25% or more (preferably 40% or more) in response to heat. At the same time, the chain stitch provides substantial stability in the machine direction.

In the illustrated exemplary construction, the shrinkable selvage stitching yarns 38 are stitched in a 14 gauge, "1 miss 3" pattern such that the shrinkable selvage stitching yarns 38 engage every fourth needle using a chain stitch notation such as 1-0,0-1, a tricot stich or the like. The stitch density of the shrinkable selvage stitching yarns 38 in the machine direction may match the elastomeric yarn to be about 5 to 20 courses per inch and is preferably about 10 courses per inch. As shown, the elastomeric stitching yarns 36 are also stitched within the selvedge zones 42 using the same patterning as in the interior stretch zone 40. Thus, the stitch pattern for the elastomeric yarns may be continuous across the fabric.

In the exemplary construction, shrinkage of both the polyester and spandex yarns stitched at coarser needle separation of 3.5 gauge in the selvedge zones 42 may cause the selvedge zones to shrink, bulk and thicken relative to the interior. As noted previously, in accordance with the present disclosure, the selvedge zones undergo controlled shrinkage through application of heat during processing to match the shrinkage at the interior. Due to the presence of the shrinkable selvage stitching yarns 38 in the selvage zones, such mutual shrinkage of the interior and the selvage results in a finished fabric wherein the selvedge zones have substantially no length-dimension stretch and recovery properties. At the same time, the selvage zones 42 may maintain a degree of stretch and recovery in the cross-machine direction due to the presence of the elastomeric stitching yarns 36 crossing the skipped stitch lines.

Figure 5:
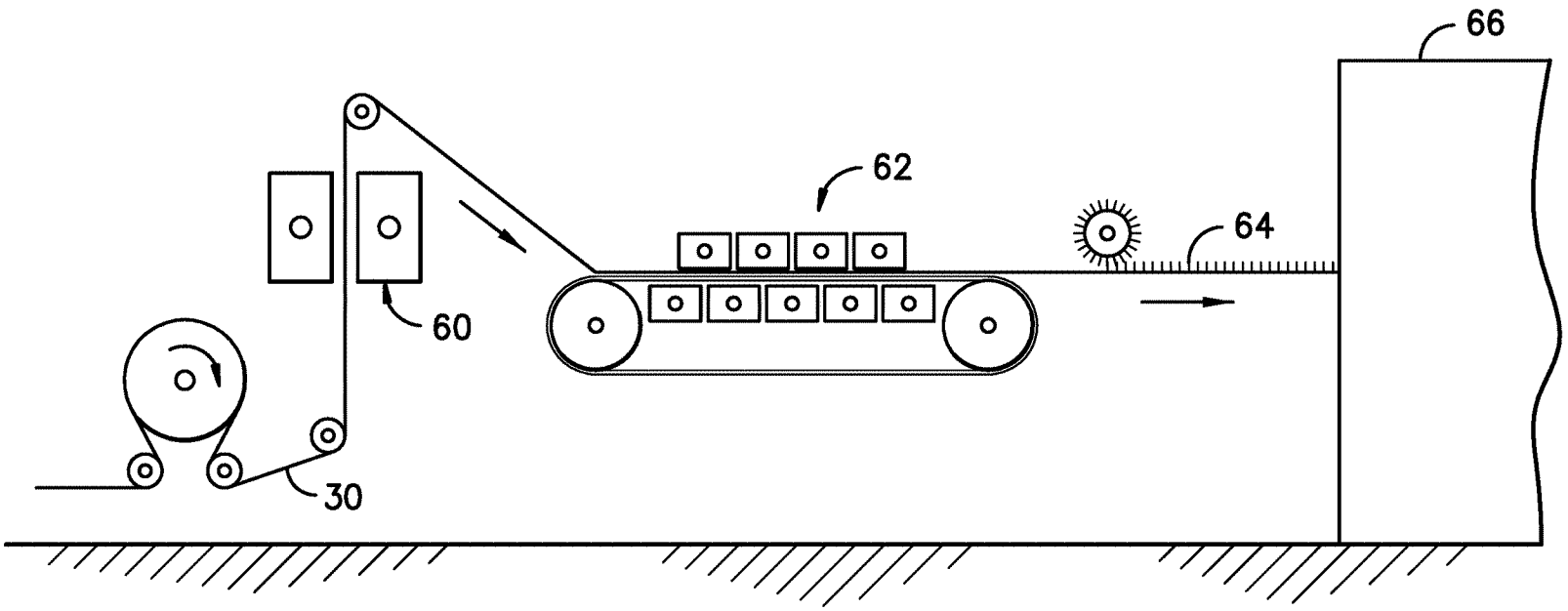
FIG. 5 is a schematic process flow diagram illustrating an exemplary method for shrinking and fixing an exemplary stitch-bonded stretchable fabric for use in a mattress consistent with the present disclosure.

Referring now to FIG. 5, in accordance with a potentially preferred practice, following the stitch-bonding procedure, the stretchable fabric 30 may be subjected to a combination of moisture and/or heat to both (i) shrink the fabric and (ii) lock in a shrunken condition within the fibrous base material 25 and optionally also within the elastomeric stitching yarns 36 such that the shrunken condition of the stretchable fabric 30 is substantially maintained even in the event of a flammability event which degrades the stitching yarn constituents. As shown in FIG. 5, to impart desired shrinkage characteristics, the stretchable fabric 30 leaving the stitch-bonding machine may be subjected to moisture at a spray station 60 followed by heating both sides at a heating station 62 using wet atmospheric steam and/or dry heat to shrink the fabric in both the machine and cross-machine dimensions.

The degree of shrinkage may be precisely controlled by setting an overfeed condition entering the heating station 62. The degree of shrinkage may be controlled by the ratio of the feed rate of fabric entering the heating station 62 versus the feed rate exiting the heating station. By providing a slower exit rate than entrance rate the fabric can relax and shrink. Thus, a greater differential between the entrance rate and exit rate will permit increased shrinkage. Under these conditions, both the interior and the selvedge shrink substantially equally in the machine direction. It will be understood that the spray station 60 may be eliminated if the heating treatment alone provides adequate shrinkage and heat setting for the fibrous base material 25. In this regard, in some environments atmospheric moisture in combination with the application of dry heat may be adequate to achieve the desired shrinkage and fixation.

In accordance with the illustrated exemplary procedure, machine direction shrinkage of about 15% or more can be achieved in the stretchable fabric 30 with a preferred shrinkage of around 30%-60%. Cross-machine direction shrinkage of 15% or more may be achieved in the fabric with a preferred shrinkage of around 20%-40%. By shrinking under controlled tension, the length and width of the fabric can shrink before being pinned or clipped onto tenter frame rails 64. At that point, the length directional shrinkage is fixed. The fabric is then dried in the tenter frame 66. Upon exiting the tenter frame 66, the dimensions of the stretchable fabric 30 and the fibrous base material 25 therein are fixed.

In the finished stretchable fabric 30, the interior stretch zone is preferably stretchable in the machine direction by not less than 15% and more preferably in the range of 20% to 60% by application of a tensile force of 2.5 pounds force per inch of sample width. In this regard, sample 10 inches in length taken with the length dimension oriented in the machine direction will preferably stretch by at least 1.5 inches, and more preferably will stretch in the range of 3 to 5 inches when subjected to a tensile stress of 7.5 pounds force per 3 inches of width. The interior stretch zone is preferably stretchable in the cross-machine direction by not less than 15% and more preferably in the range of 20% to 60% by application of a tensile force of 0.5 pounds force per inch of sample width. As will be understood, the degree of stretch under applied force may be readily adjusted within these ranges by adjusting the weight of the elastomeric yarn and/or the stitch density if desired.

According to a potentially preferred characteristic of the finished stretchable fabric 30, the force required to achieve machine direction elongation of 15% at the selvage zone 42 is substantially greater than the force required to achieve machine direction elongation of 15% at the interior stretch zone 40. This characteristic may be defined by the following ratio:

$$F_{SELV} \div F_{INT}$$

where $F_{SELV}$ is the force per inch of width required to extend the selvage by 15% and $F_{INT}$ is the force per inch of width required to extend the interior stretch zone by 15%. More specifically, in the finished stretchable fabric 30 this ratio may be 10 or greater and is more preferably in the range of about 10 to 100 and is most preferably in the range of about 20 to 200. However, higher and lower ratios may be used as desired.

In accordance with a potentially preferred practice, the shrinkage of both the spandex and POY yarns in the selvedge zones stitched at coarser needle separation of 3.5 gauge relative to the interior causes a bulking and enhanced thickness in the selvedge zones relative to the interior stretch zones. In this regard, the selvage zones may have a finished thickness at least 15% greater, and more preferably at least 40% greater than the interior stretch zones. It has been found that this bulking is beneficial in avoiding distortion when the fabric is placed onto rolls. More particularly, it has been found that a fabric of uniform thickness having a stretchable interior and a machine direction stabilized selvedge may tend to build roll diameter at a lesser rate in the selvage zones. This localized reduced diameter is believed to be due to the higher tensions applied to the selvedge zones during winding since those dimensionally stable zones act to carry the applied load during the winding operation. This differential roll thickness may lead to undesirable levels of fabric distortion. However, providing a fabric having a stretchable interior and a machine direction stabilized selvedge of enhanced thickness may tend to mitigate any disproportionate build in diameter. This benefit is believed to result from the enhanced compressibility of the thicker stabilized selvedge.

While the use of shrinkable POY yarns in the selvedge zones 42 may provide substantial advantages, it is also contemplated that other techniques may be used either alone or in combination with shrinkable stitching yarns to provide a stable selvage. By way of example only, and not limitation, it is contemplated that in some constructions stable selvages may be achieved by hemming the fabric edges using sewing machines or the like. It is also contemplated that in some constructions stable selvages may be achieved by heat fusing or adhesively laminating stabilizing structures such as threads, yarns or supporting substrates along the fabric edges. As will be appreciated, such processes would both impart stability and build thickness along the fabric edges. It is also contemplated that the stable selvage zones may be eliminated in some constructions if desired.

As noted previously, the interior fabric zone 40 having elastomeric stitching yarns 36 and free of shrinkable yarns 38 may provide a substantial degree of stretch and recovery in both the machine direction and the cross-machine direction. In this regard, the interior fabric zone 40 will have stretch and recovery capacity such that test strips which are stretched by 10% and held in that stretched state for no more than 3 seconds will recover to within 2% of their original length after 1 minute following removal of the stretching force and to within 1% of their original length after 30 minutes following removal of the stretching force. More preferably, the interior fabric zone 40 will have stretch and recovery capacity such that test strips which are stretched by up to 30% and held in that stretched state for no more than 3 seconds will recover to within 2% of their original length after 1 minute following removal of the stretching force and to within 1% of their original length after 30 minutes following removal of the stretching force. Most preferably, the interior fabric zone 40 will recover in both the machine and cross-machine directions to within 1% of the original length within 1 minute following a 10% stretch held for 3 seconds and to within 1% of the original length following a 30% stretch held for 3 seconds. Surprisingly, these characteristics of stretch and recovery may apply in both the machine direction and in the cross-machine direction thereby providing a substantially balanced stretch and recovery behavior.

In testing for these characteristics, a modified version of test method ASTM-D3107 (incorporated by reference) may be used. This modified test procedure measures recovery following predefined stretch in the following manner:

1. A three-inch-wide test sample is obtained with a length dimension aligned with the direction being tested;
2. Mark and measure benchmarks on the sample spaced 127 mm±5 mm apart;
3. Clamp one end of the test sample in hanging relation such that the other end hangs freely, and the benchmarks are at least 2 inches away from the clamp;
4. Apply a manual tensile force to the free end until the spacing between the benchmarks increases by the desired percentage and then immediately release (within no more than 3 seconds);
5. Place the sample in an unstressed flat condition and remeasure the distance between the benchmarks at 1 minute and at 30 minutes.

This testing procedure is herein referred to as the "Tietex Stretch and Recovery Evaluation."

Significantly, within the interior fabric zone 40, substantial stretching may take place in both the machine direction and in the cross-machine direction by applying relatively light loads. In this regard, the interior stretch zones may be stretchable in both the machine direction and in the cross-machine direction at least 15% and more preferably at least 30% or greater by application of a tensile force of 2.5 pounds force per inch of sample width. In testing for these stretch characteristics, ASTM test method D5035 (incorporated by reference) may be used with a grip separation of 5 inches and a sample width of 3 inches.

As noted previously, the application of heat and/or moisture in conjunction with controlled shrinkage following elastomeric yarn insertion is believed to fix the fibers in the fibrous base material in their new physical orientation within the fabric. This fixation of the fibers facilitates the ability of the stretchable fabric 30 to maintain good fire barrier properties. Specifically, in the illustrated and potentially preferred practice, the application of moisture and/or heat to FR Rayon fibers within the fabric allows the fibers to be set in their new physical orientation. By way of example only, a combination of moisture and heat may be applied by processes such as spraying, padding, foam finishing or steaming.

Regardless of the technique used to fix the fibers in the interior stretch zone following stitching, the finished stretchable fabric 30 consistent with the present disclosure will preferably be substantially stable and resistant to shrinkage from moisture or elevated temperatures. This stability is characterized by a substantial resistance to shrinkage in the presence of applied steam such that the fibrous base in a finished stretchable fabric 30 will shrink by no more than 15% (preferably 0% to 10%) in any direction when subjected to wet steam at 212 degrees Fahrenheit for 30 seconds. Thus, the flame barrier characteristics will not be adversely affected under prolonged use in a mattress in the presence of substantial heat and/or moisture.

It is also contemplated that in some constructions the elastomeric stitching yarns 36 may not be fully heat set in the finished fabric. In such constructions, the stretch and recovery characteristics as described above will still apply. However, such a construction may retain some degree of latent dimensional instability in the presence of heat and/or moisture such that shrinkage may occur when wet steam is applied. Such fabrics wherein the fibrous base material 25 has been shrunk and heat set but wherein the elastomeric stitching yarns 36 are not fully heat set, may nonetheless be beneficial and suitable as a flame barrier fabric in many applications.

To still further promote stretch and recovery in any of the products consistent with the present disclosure, it may be desirable to reduce friction between fibers within the fibrous base material 25 to promote the ability of those fibers to reorient and move in response to stretching and/or recovery forces. By way of example only, and not limitation, a fiber finish such as a silicone finish or the like may be applied to the fibers making up the fibrous base material. Alternatively, the fibrous base material may include a relatively small percentage of lubricating fibers such as siliconized polyester fibers or the like blended with other fibers without a lubricating finish to provide a controlled degree of lubricity within the fibrous base material. Regardless of the technique used, the reduction of fiber-to-fiber friction within the fibrous base material may be useful in promoting stretch and recovery.

Example

A non-limiting example of a stretchable fabric 30 consistent with the present disclosure will now be described.

Construction

A stitch-bonded fabric with an interior stretch zone and stable selvages was produced using a 70 denier Spandex stitching yarn air covered with 70 denier/34 filament textured polyester with a stretch rating of 300% stitched through a 100% FR Rayon fleece with a mass per unit area of 95 g/m$^2$ to form an interior stretch zone. The fleece had undergone drafting to reduce the width from 163 inches to 125 inches prior to stitching. The Spandex was stitched at the interior stretch zone in a stitch pattern as shown in FIG. 4 with a notation of 1-0/0-1/1-0/2-3/4-5/5-4/4-5/3-2// at 14 gauge. The selvage zones of the fabric were stitched with the spandex stitching yarn as described above in combination with a heat-shrinkable 285 denier/36 filament POY polyester as shown in FIG. 4. The stitch notation for the POY was 1-0,0-1 at 14 gauge. The machine direction stitch density was 10 courses per inch for both yarns. The stitched fabric was thereafter finished in accordance with the techniques described in relation to FIG. 5. The fabric had a knitted width of 114.9 inches and a finished width of 92 inches. The finished weight was 197 g/m2.

Stretch and Recovery

When tested in accordance with the Tietex Stretch and Recovery Evaluation at 10% stretch, the finished fabric from the interior stretch zone recovered fully with no measurable deformation within 1 minute after being stretched in the machine direction and to within 1% of the original length within 1 minute after being stretched in the cross-machine direction. When tested in accordance with the Tietex Stretch and Recovery Evaluation at 30% stretch, the finished fabric from the interior stretch zone recovered to within 1% of the original length within 1 minute after being stretched in the machine direction and to within 3% of the original length within 1 minute after being stretched in the cross-machine direction. When tested in accordance with the Tietex Stretch and Recovery Evaluation at 30% stretch, a finished fabric sample from the interior stretch zone recovered fully with no measurable deformation within 30 minutes after being stretched in the machine direction and to within 1% of the original length within 30 minutes after being stretched in the cross-machine direction.

Stretch Under Loading

When stretched using ASTM test method D5035 with a grip separation of 5 inches and a sample width of 3 inches, the interior stretch zone of the finished fabric had stretch characteristics according to the following table:

| Direction | Load at 15% Stretch | Load at 20% Stretch | Load at 25% Stretch | Load at 30% Stretch | Load at 35% Stretch | Load at 40% Stretch | Load at 45% Stretch |
|---|---|---|---|---|---|---|---|
| Machine | 0.60 lbf | 1.15 lbf | 2.21 lbf | 4.30 lbf | 7.65 lbf | 11.97 lbf | 15.31 lbf |
| Cross Machine | 0.33 lbf | 0.51 lbf | 0.78 lbf | 1.15 lbf | 1.66 lbf | 2.33 lbf | 3.36 lbf |

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A stretchable flame barrier fabric having a machine direction and a cross-machine direction, the fabric comprising: an interior stretch zone having a first thickness, the interior stretch zone comprising a fibrous base comprising textile fibers, the interior stretch zone further comprising a plurality of elastomeric yarns disposed in stitch bonded or quilted relation through the fibrous base, and wherein the interior stretch zone is characterized by a stretch and recovery capacity such that test strips from the interior stretch zone are stretchable in the machine direction by not less than 15% by application of a tensile force of 2.5 pounds force per inch of width and test strips which are stretched by 10% and held in that stretched state for no more than 3 seconds will recover to within 2% of their original length after 1 minute following removal of the stretching force and to within 1% of their original length after 30 minutes following removal of the stretching force, and wherein either (i) the plurality of elastomeric yarns are not fully heat set or (ii) the stretchable fabric will shrink by no more than 0% to 15% in any direction when subjected to wet steam at 212 degrees Fahrenheit for 30 seconds, the flame barrier fabric further comprising a pair of lateral selvage zones defining fabric edges outboard from the interior stretch zone, the selvage zones having a second thickness greater than the first thickness and wherein the plurality of elastomeric yarns are disposed in a partially threaded stitch bonded pattern within the interior stretch zone and the selvage zones with lateral shifting between needle lines and wherein the selvage zones further comprise a plurality of shrunken non-elastomeric yarns disposed in stitched relation through the fibrous base stitching substrate.

2. The stretchable flame barrier fabric as recited in claim 1, wherein at least a majority of said textile fibers are disposed at an angle between 25 degrees and 75 degrees relative to a line extending parallel to the cross-machine direction.

3. The stretchable flame barrier fabric as recited in claim 1, wherein the force required to achieve machine direction elongation of 15% at the selvage zones is at least 2 times greater than the force required to achieve machine direction elongation of 15% at the interior stretch zones.

4. The stretchable flame barrier fabric as recited in claim 1, wherein the force required to achieve machine direction elongation of 15% at the selvage zones is at least 10 times greater than the force required to achieve machine direction elongation of 15% at the interior stretch zones.

5. The stretchable flame barrier fabric as recited in claim 1, wherein the second thickness is at least at least 15% greater than the first thickness.

6. The stretchable flame barrier fabric as recited in claim 1, wherein the second thickness is at least at least 25% greater than the first thickness.

7. The stretchable flame barrier fabric as recited in claim 1, wherein the second thickness is at least at least 40% greater than the first thickness.

8. The stretchable flame barrier fabric as recited in claim 1, wherein the textile fibers are selected from the group consisting of: silica rayon fiber; rayon fibers treated with flame retardant chemicals; polyester fibers; polyester fibers treated with flame retardant chemicals; para-aramid fibers; meta-aramid fibers; modacrylic fibers; wool and combinations of any of the forgoing.

9. The stretchable flame barrier fabric as recited in claim 1, wherein the plurality of elastomeric yarns are wrapped spandex yarns.

10. The stretchable flame barrier fabric as recited in claim 1, wherein the plurality of elastomeric yarns have a stretch capacity of at least 100% prior to breakage.

11. The stretchable flame barrier fabric as recited in claim 1, wherein the plurality of shrunken non-elastomeric yarns are stitched in a partially threaded pattern within the selvage zones in straight lines without lateral shifting between needle lines and at a coarser gauge than the elastomeric yarns.

12. The stretchable flame barrier fabric as recited in claim 11, wherein the plurality of elastomeric stitching yarns and the plurality of shrunken non-elastomeric yarns are each disposed in stitched relation through the stitching substrate at the same number of stitches per inch in the machine direction.

13. The stretchable flame barrier fabric as recited in claim 12, wherein the plurality of elastomeric stitching yarns and the plurality of shrunken non-elastomeric yarns are each disposed in stitched relation through the stitching substrate at a stich density of at least 10 stitches per inch in the machine direction.

14. A stretchable flame barrier fabric having a machine direction and a cross-machine direction, the fabric comprising: an interior stretch zone having a first thickness, the interior stretch zone comprising a fibrous base comprising textile fibers, the interior stretch zone further comprising a plurality of elastomeric yarns disposed in stitch bonded or quilted relation through the fibrous base, and wherein the interior stretch zone is characterized by a stretch and recovery capacity such that test strips from the interior stretch zone are stretchable in the machine direction by not less than 15% by application of a tensile force of 2.5 pounds force per inch of width and test strips which are stretched by 10% in the machine direction and held in that stretched state for no more than 3 seconds will recover to within 2% of their original length after 1 minute following removal of the stretching force and to within 1% of their original length after 30 minutes following removal of the stretching force, and wherein test strips from the interior stretch zone are stretchable in the cross-machine direction by not less than 15% by application of a tensile force of 1.5 pounds force per inch of width and test strips which are stretched by 10% in the cross-machine direction and held in that stretched state for no more than 3 seconds will recover to within 3% of their original length after 1 minute following removal of the stretching force and to within 1% of their original length after 30 minutes following removal of the stretching force, and wherein either (i) the plurality of elastomeric yarns are not fully heat set or (ii) the stretchable fabric will shrink by no more than 0% to 15% in any direction when subjected to wet steam at 212 degrees Fahrenheit for 30 seconds, the stretchable flame barrier fabric further comprising a pair of lateral selvage zones defining fabric edges outboard from the interior stretch zone, the selvage zones having a second thickness at least 25% greater than the first thickness, wherein the interior stretch zone and the selvage zones comprise a common fibrous base comprising textile fibers, wherein at least a majority of said textile fibers are oriented at an angle between 25 degrees and 75 degrees relative to a line extending parallel to the cross-machine direction, the interior stretch zone and the selvage zones all further comprising a plurality of elastomeric stitching yarns disposed in stitched relation through the fibrous base, and wherein the selvage zones further comprise a plurality of shrunken non-elastomeric yarns disposed in stitched relation through the fibrous base wherein the force required to achieve machine direction elongation of 15% at the selvage zones is at least 25 times greater than the force required to achieve machine direction elongation of 15% at the interior stretch zones and wherein the stretchable fabric will shrink no more than 0% to 15% in any direction when subjected to wet steam at 212 degrees Fahrenheit for 30 seconds.

* * * * *